US007882621B2

(12) United States Patent
Chen et al.

(10) Patent No.: US 7,882,621 B2
(45) Date of Patent: Feb. 8, 2011

(54) METHOD FOR MAKING CHIP RESISTOR COMPONENTS

(75) Inventors: Mu-Yuan Chen, Taipei Hsien (TW); Wen-Feng Wu, Taipei Hsien (TW); Chi-Pin Chang, Taipei Hsien (TW); Kao-Po Chien, Taipei Hsien (TW)

(73) Assignee: Yageo Corporation, Hsin-Tien (TW)

( * ) Notice: Subject to any disclaimer, the term of this patent is extended or adjusted under 35 U.S.C. 154(b) by 518 days.

(21) Appl. No.: 12/040,234

(22) Filed: Feb. 29, 2008

(65) Prior Publication Data

US 2009/0217511 A1 Sep. 3, 2009

(51) Int. Cl.
*H01C 17/28* (2006.01)

(52) U.S. Cl. ..... 29/621; 29/610.1; 29/620; 29/829; 438/382

(58) Field of Classification Search ..... 29/621, 29/610.1, 612, 619, 620, 829, 830; 438/125, 438/382, 940

See application file for complete search history.

(56) References Cited

U.S. PATENT DOCUMENTS 6,998,220 B2 * 2/2006 Werner et al. ..... 430/311
7,098,532 B2 * 8/2006 Naito et al. ..... 257/700

* cited by examiner

*Primary Examiner*—Thiem Phan
(74) *Attorney, Agent, or Firm*—Abelman, Frayne & Schwab

(57) ABSTRACT

A method for making chip resistor components includes: (a) forming a plurality of first and second notches in a substrate so as to form resistor-forming strips; (b) forming pairs of upper and lower electrodes on each of the resistor-forming strips; (c) forming a resistor film on each of the resistor-forming strips; (d) forming an insulator layer on the resistor film; (e) forming a hole pattern in the insulator layer and the resistor film; (f) forming an insulating shield layer on the insulator layer; (g) cleaving the substrate along the first notches so as to form a plurality of strip-like semi-finished products; (h) forming a pair of side electrodes on two opposite sides of each of the semi-finished products; and (i) cleaving each of the semi-finished products.

14 Claims, 11 Drawing Sheets

METHOD FOR MAKING CHIP RESISTOR COMPONENTS

BACKGROUND OF THE INVENTION

1. Field of the Invention

This invention relates to a method for making chip resistor components.

2. Description of the Related Art

U.S. Patent Application Publication No. 2003/0156008 discloses a resistor including a substrate, a pair of upper electrode layers formed on an upper surface of the substrate, a resistor layer formed on the upper surface of the substrate and connected to the upper electrode layers, a protective layer covering the resistor layer, a pair of L-shaped first side electrode layers formed on two sides and end portions of a lower surface of the substrate and contacting the respective upper electrode layer, a pair of L-shaped second side electrode layers covering respectively the first side electrode layer, a pair U-shaped first plating layers covering respectively the second side electrode layers and the upper electrode layers, and a pair of U-shaped second plating layers covering respectively the first plating layers. The aforesaid conventional resistor has a relatively complex structure. Hence, there is a need to develop a method for making a resistor component that is simple and cost effective.

SUMMARY OF THE INVENTION

The object of the present invention is to provide a method for making chip resistor component that is simple and cost effective.

According to the present invention, a method for making chip resistor components comprises: (a) forming a plurality of intersecting strip-like first and second notches in a dielectric substrate so as to form a plurality of resistor-forming strips separated by the first notches; (b) forming a pair of spaced apart strip-like upper electrodes on an upper surface of each of the resistor-forming strips, and a pair of spaced apart strip-like lower electrodes on a lower surface of each of the resistor-forming strips, the upper and lower electrodes being substantially parallel to the first notches; (c) forming a strip-like resistor film on the lower surface of each of the resistor-forming strips such that the resistor film extends between and is brought into contact with the lower electrodes; (d) forming a strip-like insulator layer on the resistor film; (e) forming a hole pattern in the insulator layer and the resistor film; (f) forming a strip-like insulating shield layer on the insulator layer; (g) cleaving the dielectric substrate along the first notches so as to form a plurality of strip-like semi-finished products; (h) forming a pair of strip-like side electrodes on two opposite sides of each of the semi-finished products such that each of the side electrodes extends between and is brought into contact with an adjacent one of the upper electrodes and an adjacent one of the lower electrodes; and (i) cleaving each of the semi-finished products along the second notches so as to form a plurality of resistor blanks.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
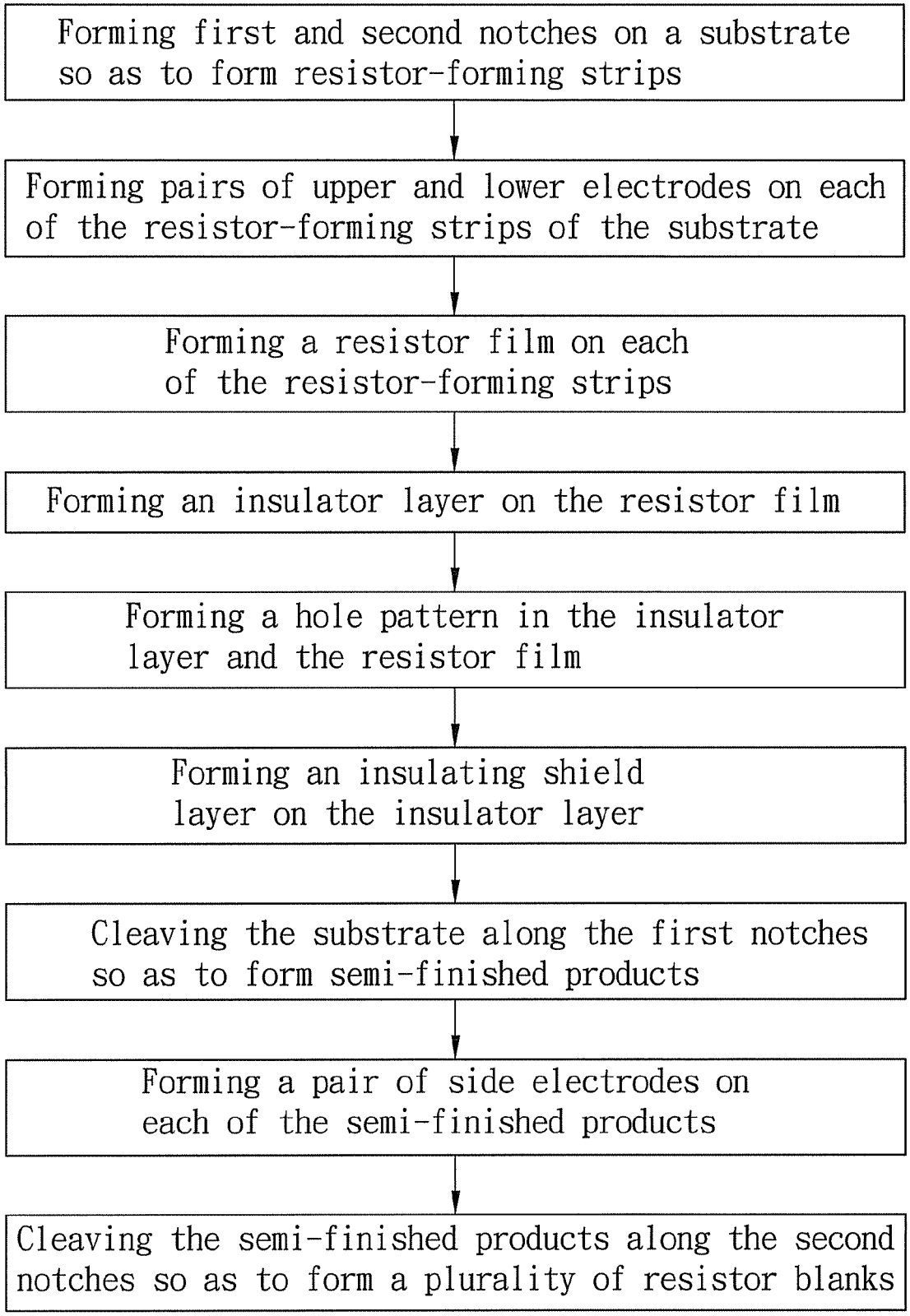
FIG. 1 is a flowchart to illustrate consecutive steps of the preferred embodiment of a method for making chip resistor components according to the invention.

FIG. 1 illustrates consecutive steps of the preferred embodiment of a method for making chip resistor components according to this invention.

Figure 2:
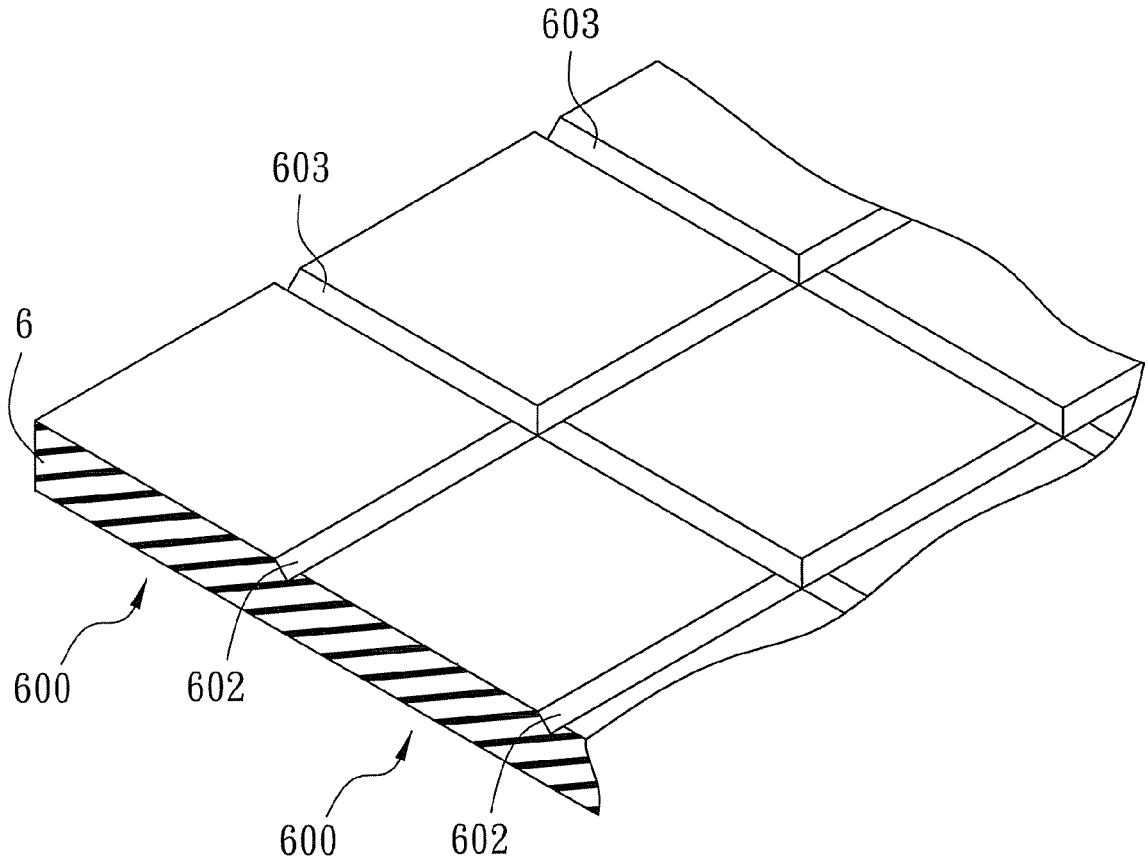
FIG. 2 is a fragmentary perspective view to illustrate configurations of a plurality of first and second notches formed in a substrate according to the method of the preferred embodiment.
Figure 3:
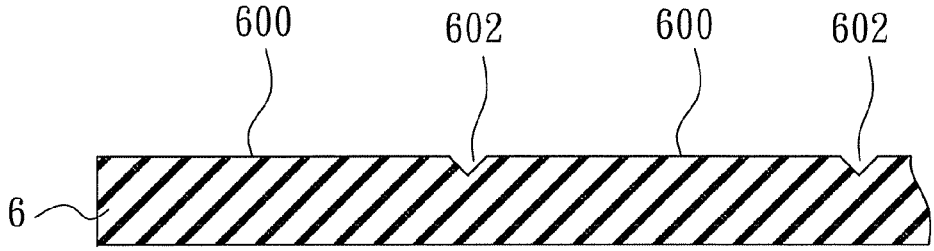
FIG. 3 is a fragmentary sectional view of FIG. 2.
Figure 4:
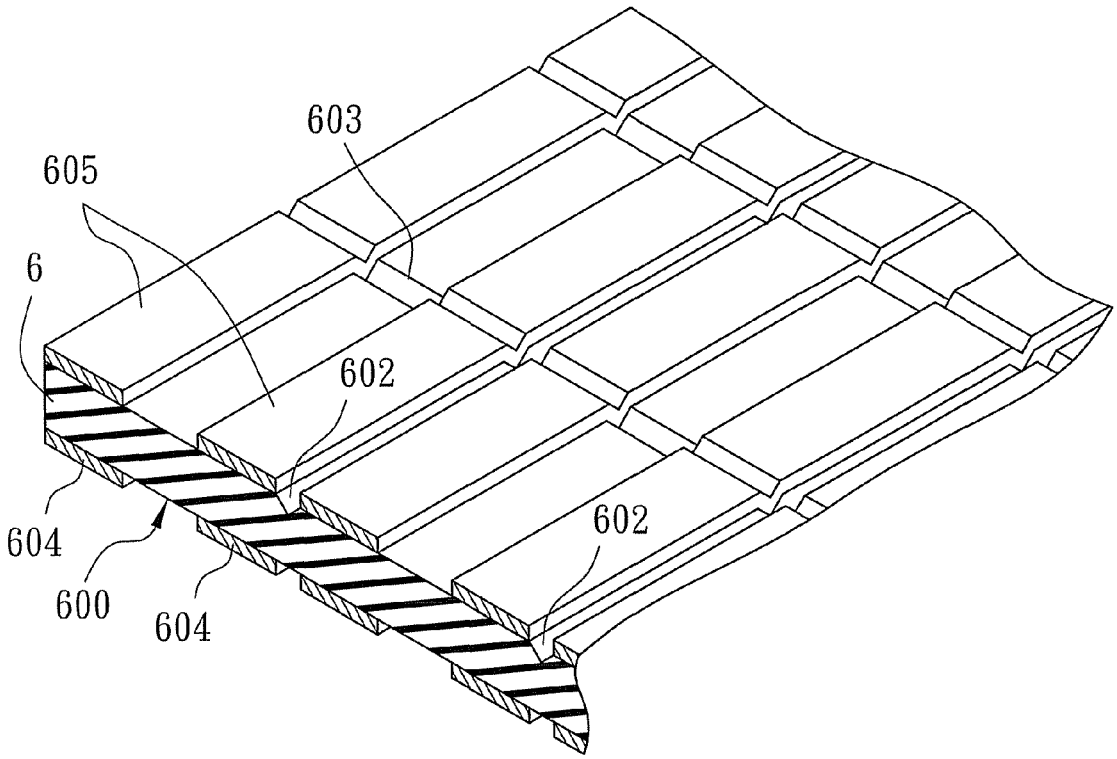
FIG. 4 is a fragmentary perspective view to illustrate configurations of pairs of upper and lower electrodes formed on each of resistor-forming strips of the substrate according to the method of the preferred embodiment.
Figure 5:
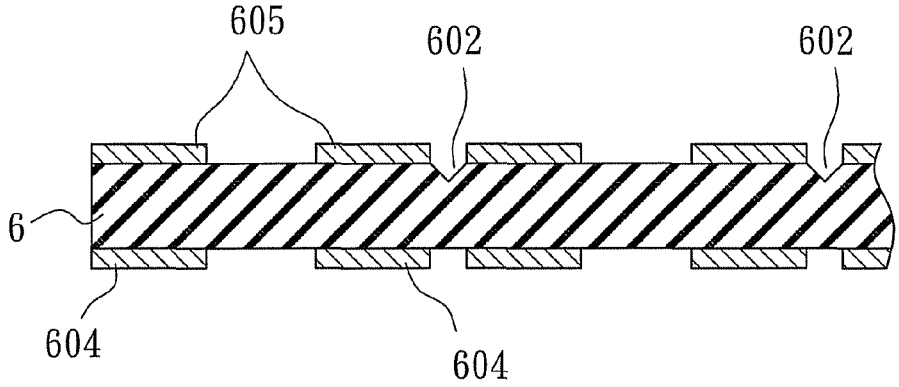
FIG. 5 is a fragmentary sectional view of FIG. 4.
Figure 6:
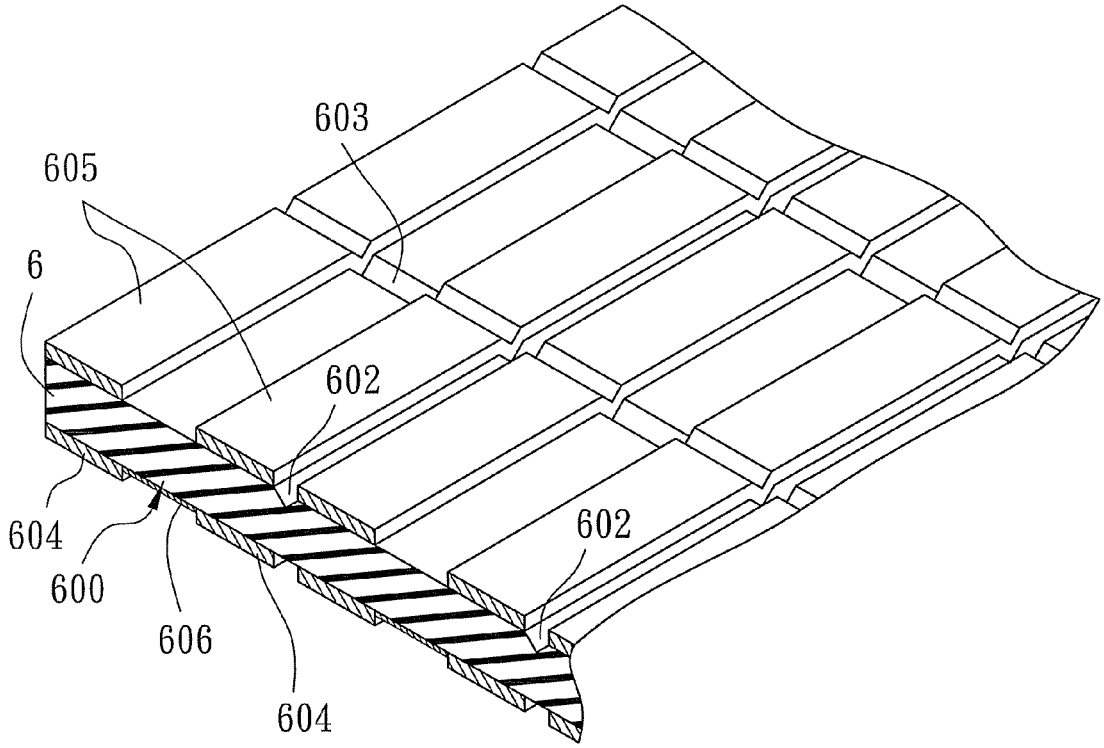
FIG. 6 is a fragmentary perspective view to illustrate a configuration of a resistor film formed on a lower surface of each of the resistor-forming strips according to the method of the preferred embodiment.
Figure 7:
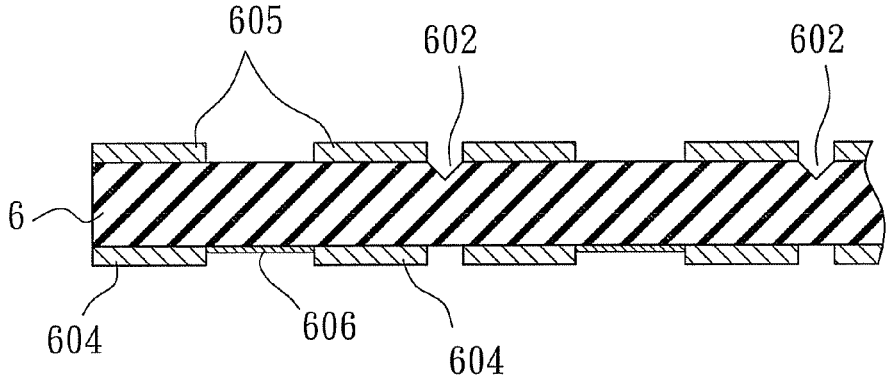
FIG. 7 is a fragmentary sectional view of FIG. 6.
Figure 8:
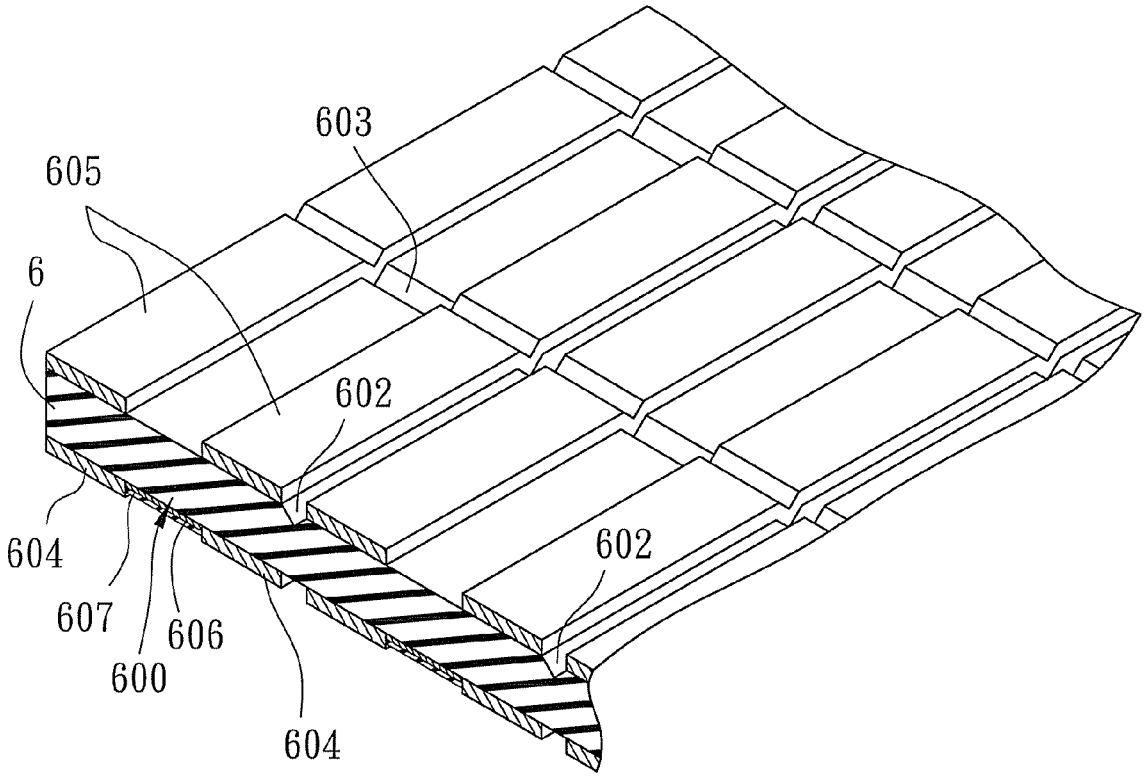
FIG. 8 is a fragmentary perspective view to illustrate a configuration of an insulator layer formed on the resistor film according to the method of the preferred embodiment.
Figure 9:
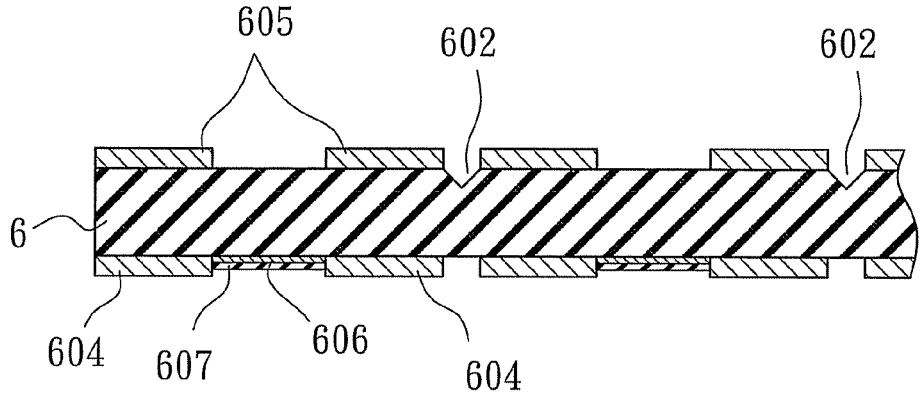
FIG. 9 is a fragmentary sectional view of FIG. 8.
Figure 10:
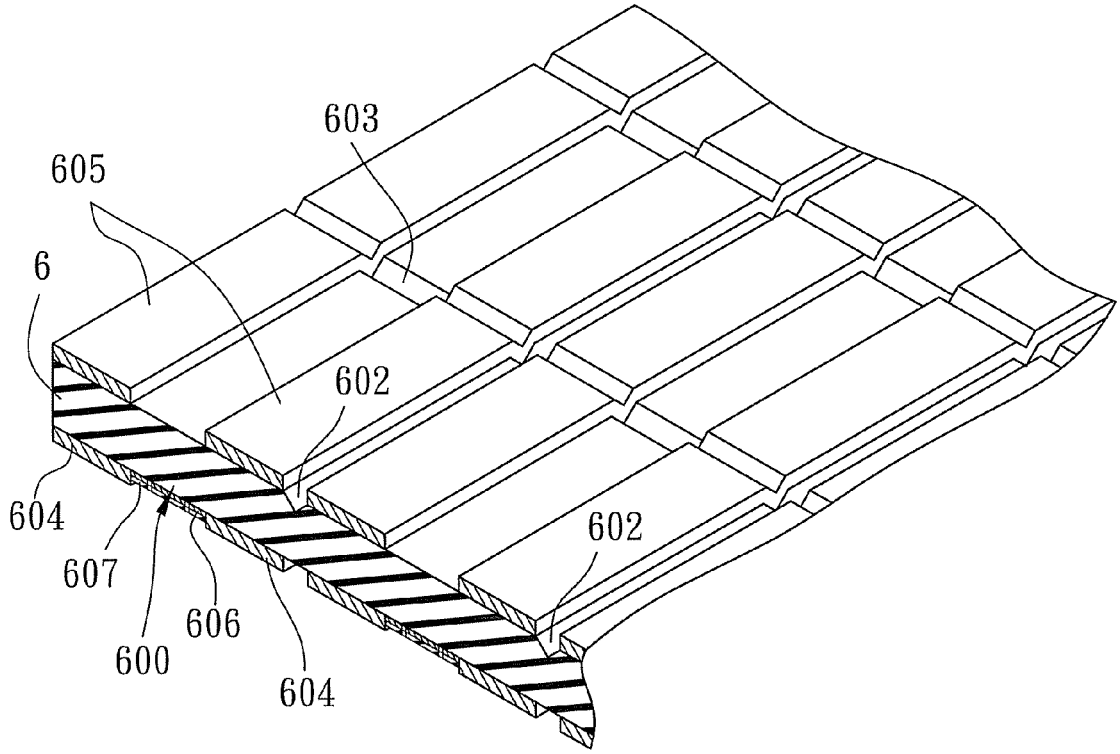
FIG. 10 is a fragmentary perspective view to illustrate a configuration of a hole pattern formed in the insulator layer and the resistor film according to the method of the preferred embodiment.
Figure 11:
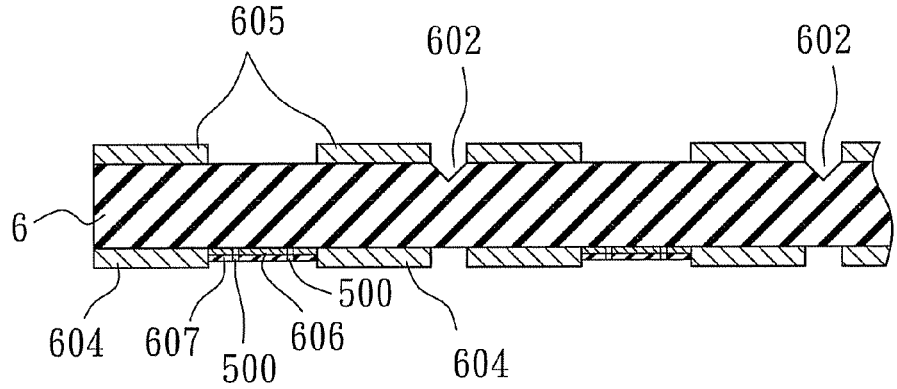
FIG. 11 is a fragmentary sectional view of FIG. 10.
Figure 12:
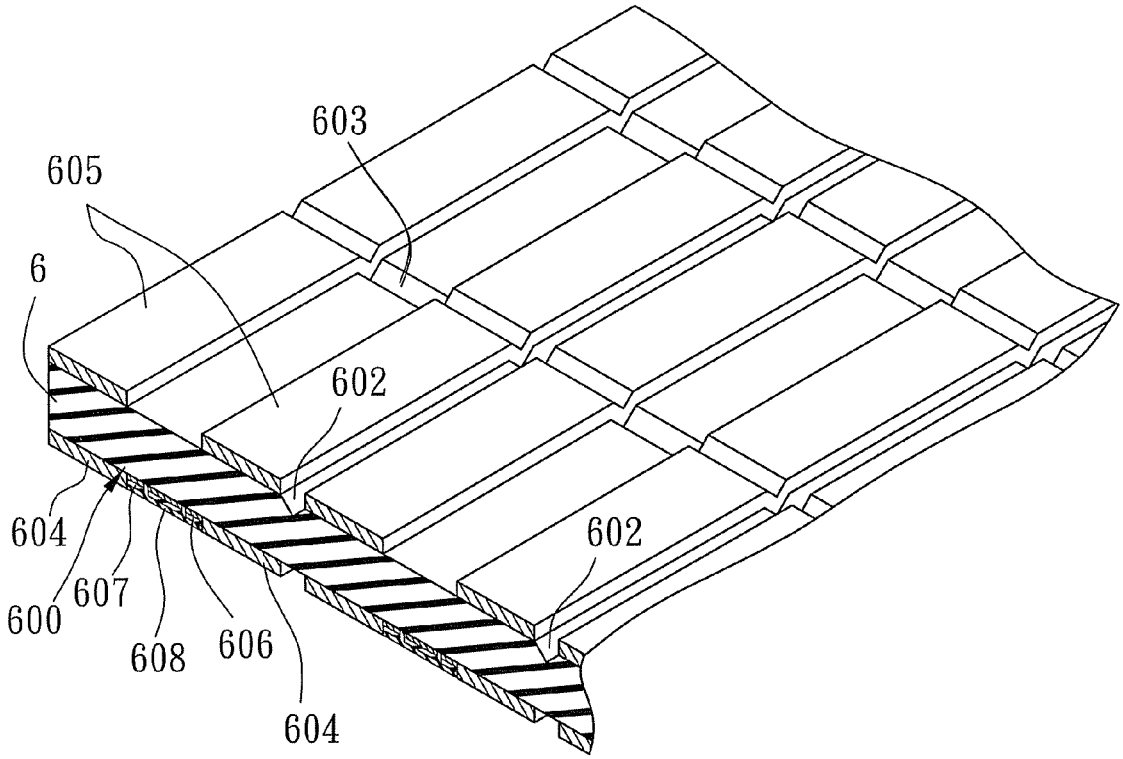
FIG. 12 is a fragmentary perspective view to illustrate a configuration of an insulating shield layer formed on the insulator layer according to the method of the preferred embodiment.
Figure 13:
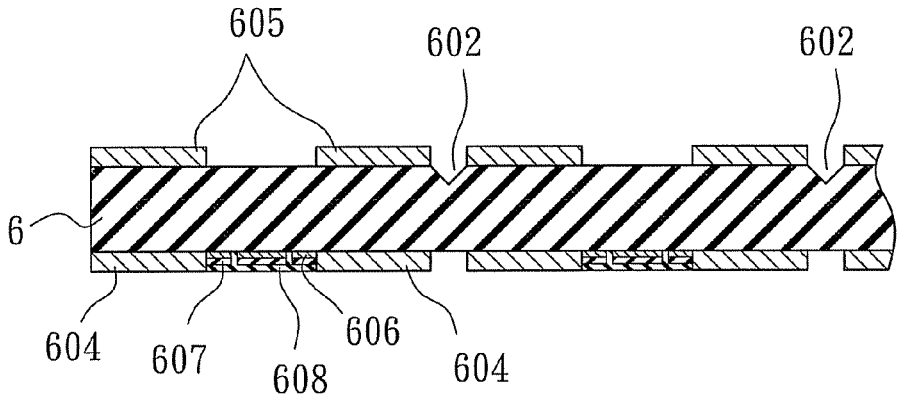
FIG. 13 is a fragmentary sectional view of FIG. 12.
Figure 14:
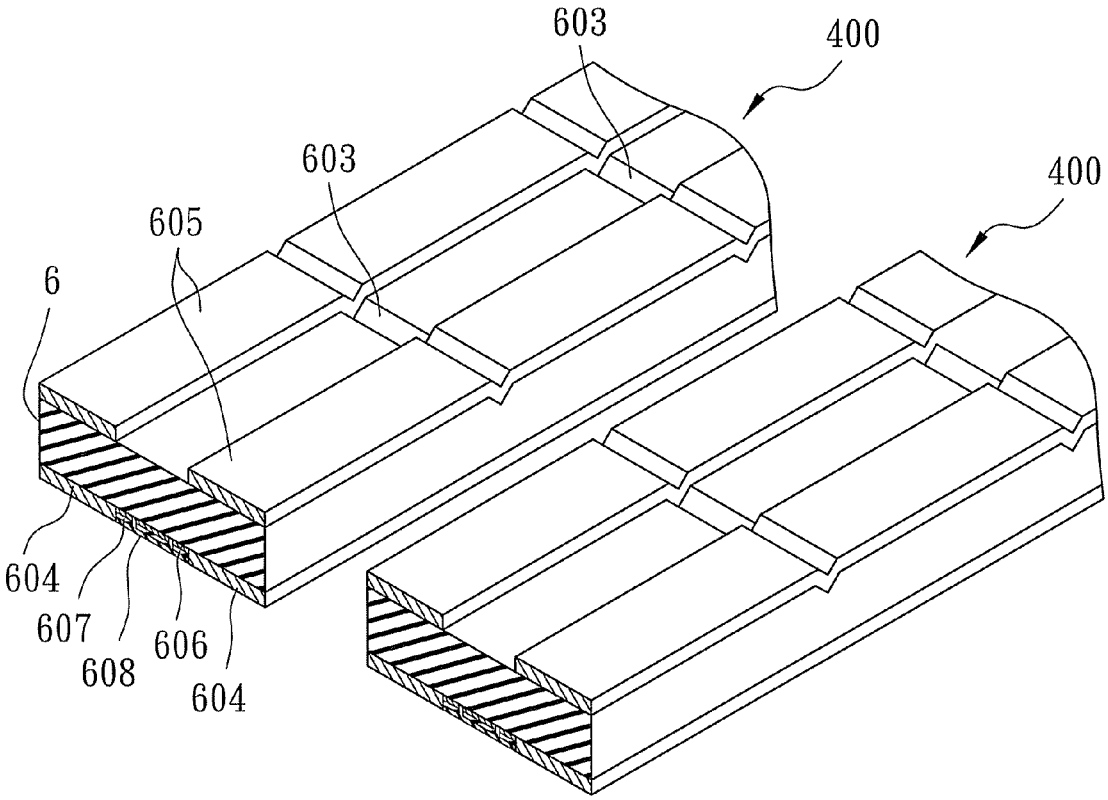
FIG. 14 is a fragmentary perspective view to illustrate how a plurality of semi-finished products are formed according to the method of the preferred embodiment.
Figure 15:
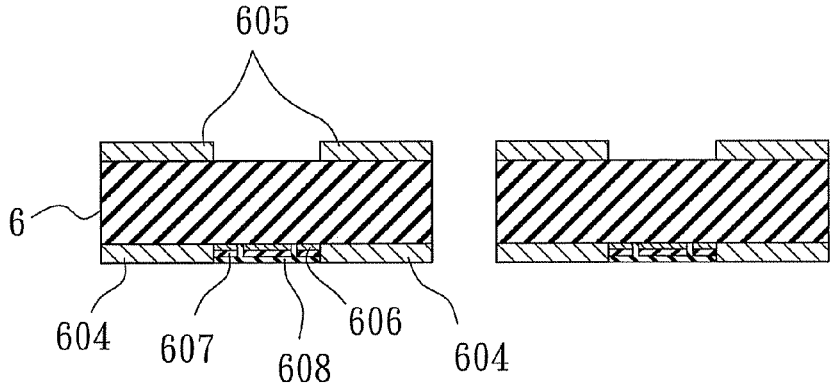
FIG. 15 is a sectional view of FIG. 14.
Figure 16:
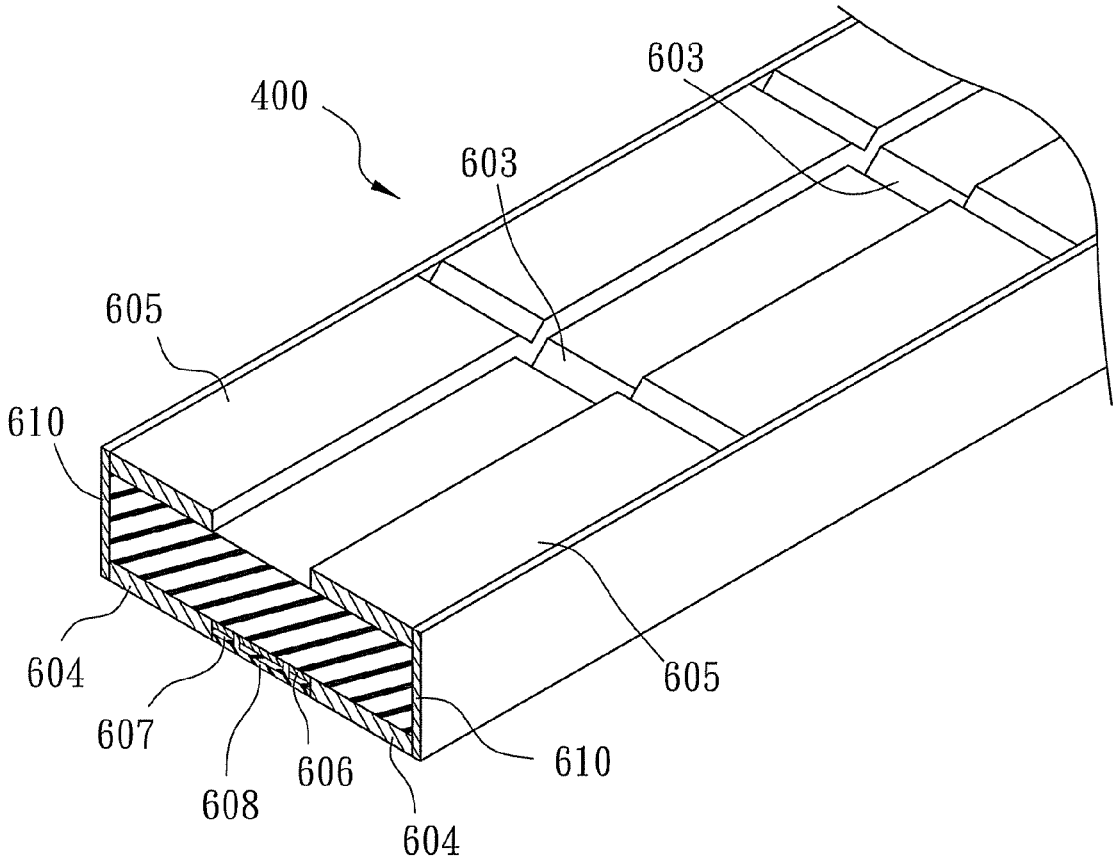
FIG. 16 is a fragmentary perspective view to illustrate configurations of a pair of side electrodes formed on two opposite sides of each of the semi-finished products according to the method of the preferred embodiment.
Figure 17:
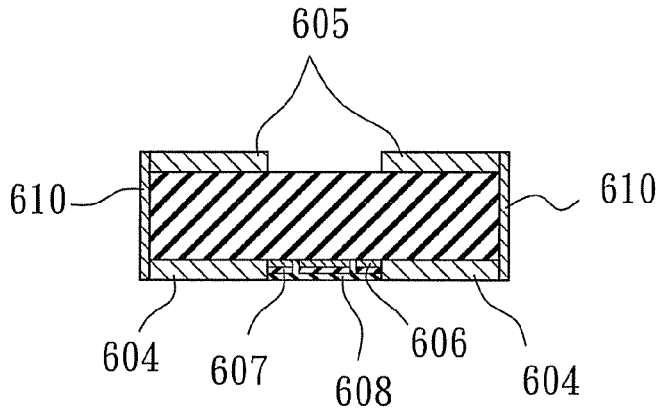
FIG. 17 is a sectional view of FIG. 16.
Figure 18:
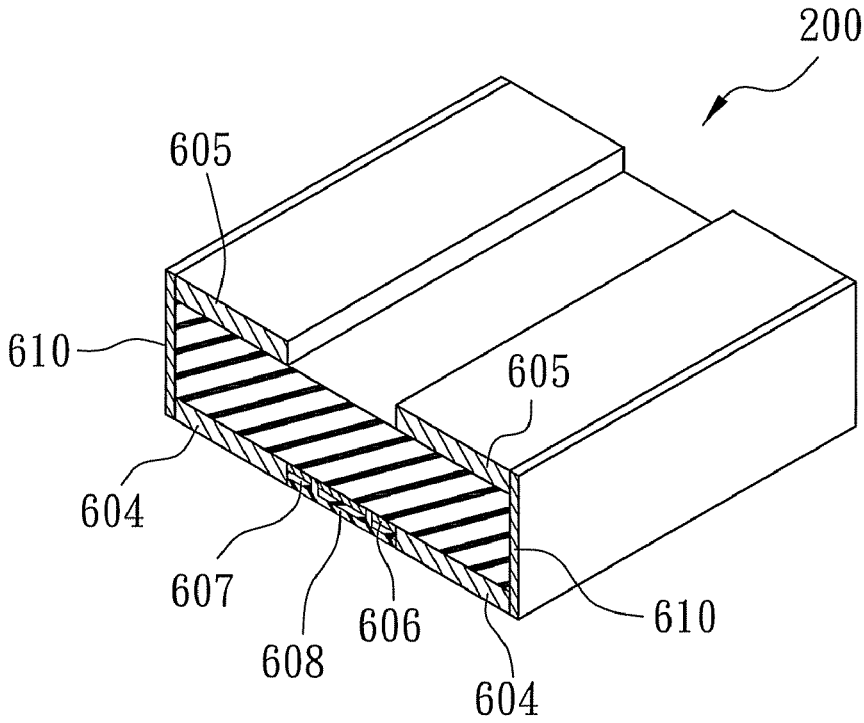
FIG. 18 is a perspective view to illustrate how a resistor blank is formed according to the method of the preferred embodiment.
Figure 19:
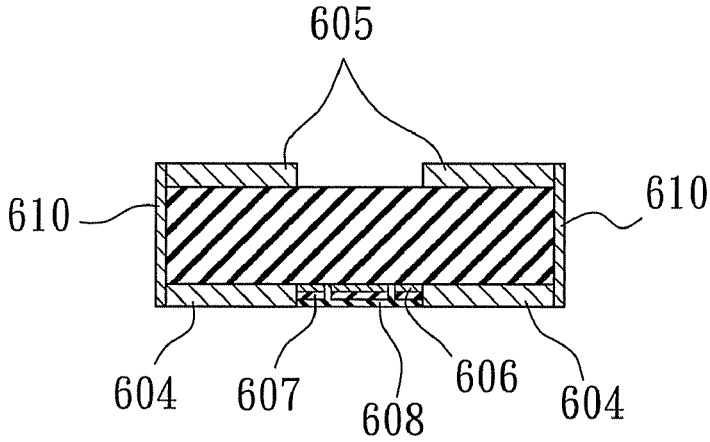
FIG. 19 is a sectional view of FIG. 18.

The method for making chip resistor components includes: (a) forming a plurality of intersecting strip-like first and second notches 602, 603 in a dielectric substrate 6 so as to form a plurality of resistor-forming strips 600 separated by the first notches 602 (see FIGS. 2 and 3); (b) forming a pair of spaced apart strip-like upper electrodes 605 on an upper surface of each of the resistor-forming strips 600, and a pair of spaced apart strip-like lower electrodes 604 on a lower surface of each of the resistor-forming strips 600, the upper and lower electrodes 605, 604 being substantially parallel to the first notches 602 (see FIGS. 4 and 5); (c) forming a strip-like resistor film 606 on the lower surface of each of the resistor-forming strips 600 such that the resistor film 606 extends between and is brought into contact with the lower electrodes 604 (see FIGS. 6 and 7); (d) forming a strip-like insulator layer 607 on the resistor film 606 (see FIGS. 8 and 9); (e) forming a hole pattern 500 in the insulator layer 607 and the resistor film 606 in order to adjust a resistance of the resistor film 606 (see FIGS. 10 and 11); (f) forming a strip-like insulating shield layer 608 on the insulator layer 607, thereby covering the resistor film 606 and the insulator layer 607 (see FIGS. 12 and 13); (g) cleaving the dielectric substrate 6 along the first notches 602 so as to form a plurality of strip-like semi-finished products 400 (see FIGS. 14 and 15); (h) forming a pair of strip-like side electrodes 610 on two opposite sides of each of the semi-finished products 400 such that each of the side electrodes 610 extends between and is brought into contact with an adjacent one of the upper electrodes 605 and an adjacent one of the lower electrodes 604 (see FIGS. 16 and 17); and (i) cleaving each of the semi-finished products 400 along the second notches 603 so as to form a plurality of resistor blanks 200 (see FIGS. 18 and 19).

Figure 20:
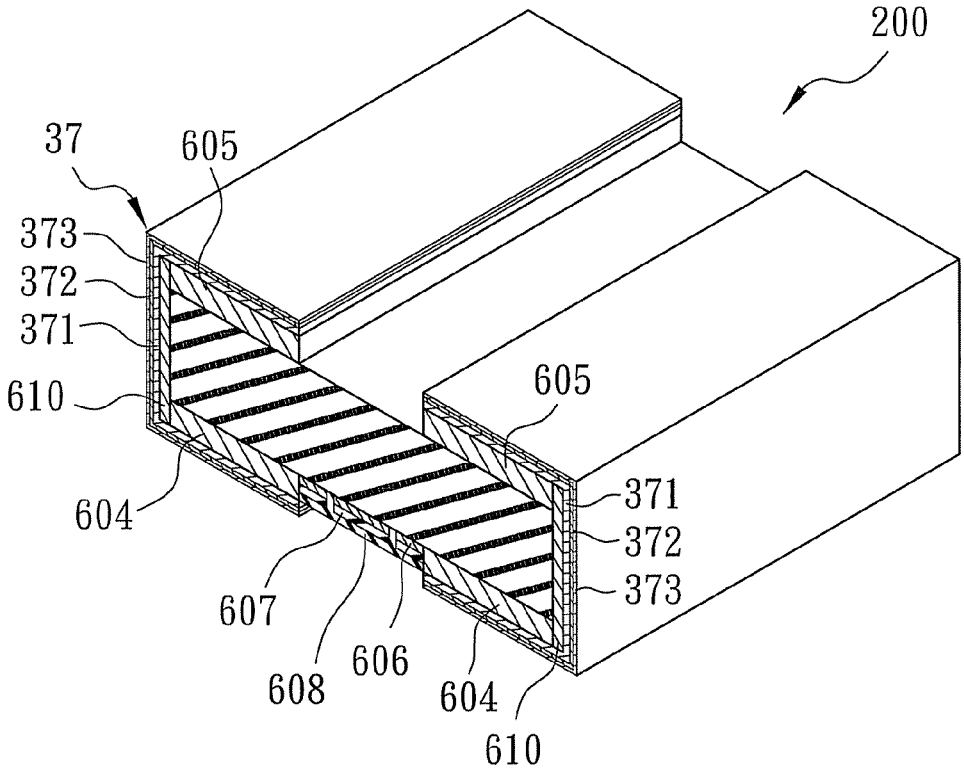
FIG. 20 is a perspective view to illustrate configurations of first, second, and third plating layers formed on the side electrodes according to the method of the preferred embodiment.
Figure 21:
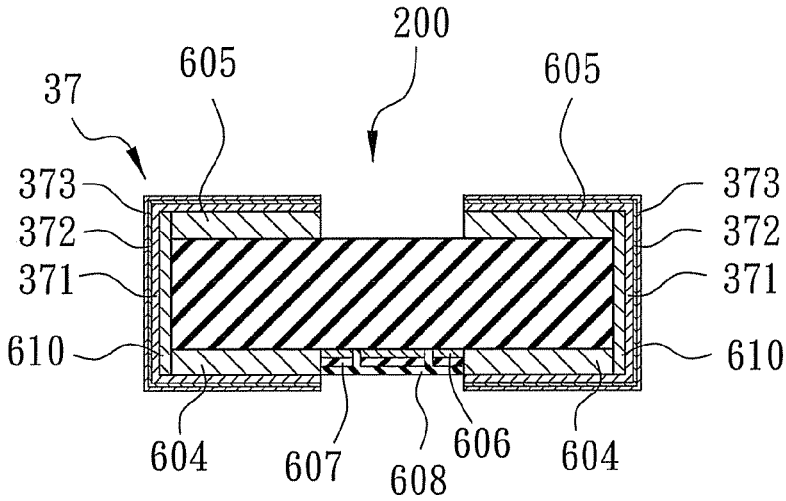
FIG. 21 is a sectional view of FIG. 20.

In this embodiment, the method further includes forming a first plating layer 371 on each of the resistor blanks 200 after step (i) such that the first plating layer 371 covers an adjacent one of the upper electrodes 605, an adjacent one of the side electrodes 610, and an adjacent one of the lower electrodes 604 (see FIGS. 20 and 21).

In this embodiment, the method further includes forming a second plating layer 372 on each of the resistor blanks 200 such that the second plating layer 372 covers the first plating layer 371, and a third plating layer 373 on each of the resistor blanks 200 such that the third plating layer 373 covers the second plating layer 372 (see FIGS. 20 and 21).

Preferably, the dielectric substrate 6 is made from a material, such as a glass, a ceramic material, or an epoxy resin.

Preferably, the first and second notches 602, 603 have a depth relative to the dielectric substrate 6 in the order of micrometers.

Preferably, formation of the upper electrodes 605 in step (b) is conducted through printing techniques.

Preferably, formation of the lower electrodes 604 in step (b) is conducted through one of printing techniques, foil laminating techniques, sputtering techniques, and coating techniques.

Preferably, formation of the strip-like resistor film 606 in step (c) is conducted through one of printing techniques, foil laminating techniques, and sputtering techniques.

Preferably, formation of the hole pattern 500 in step (e) is conducted using laser techniques.

Preferably, formation of the strip-like side electrodes 610 in step (h) is conducted using a silver paste or through sputtering techniques.

In this embodiment, formation of the strip-like side electrodes 610 is conducted using a silver paste.

In this embodiment, the first, second, and third plating layers 371, 372, 373 are made of copper, nickel, and tin, respectively.

The method of this invention is capable of simplifying the processing steps and lowering the operating costs during mass production of the resistor components.

With the invention thus explained, it is apparent that various modifications and variations can be made without departing from the spirit of the present invention. It is therefore intended that the invention be limited only as recited in the appended claims.

What is claimed is:

1. A method for making chip resistor components, comprising:

(a) forming a plurality of intersecting strip-like first and second notches in a dielectric substrate so as to form a plurality of resistor-forming strips separated by the first notches;

(b) forming a pair of spaced apart strip-like upper electrodes on an upper surface of each of the resistor-forming strips, and a pair of spaced apart strip-like lower electrodes on a lower surface of each of the resistor-forming strips, the upper and lower electrodes being substantially parallel to the first notches;

(c) forming a strip-like resistor film on the lower surface of each of the resistor-forming strips such that the resistor film extends between and is brought into contact with the lower electrodes;

(d) forming a strip-like insulator layer on the resistor film;

(e) forming a hole pattern in the insulator layer and the resistor film;

(f) forming a strip-like insulating shield layer on the insulator layer;

(g) cleaving the dielectric substrate along the first notches so as to form a plurality of strip-like semi-finished products;

(h) forming a pair of strip-like side electrodes on two opposite sides of each of the semi-finished products such that each of the side electrodes extends between and is brought into contact with an adjacent one of the upper electrodes and an adjacent one of the lower electrodes; and (i) cleaving each of the semi-finished products along the second notches so as to form a plurality of resistor blanks.

2. The method of claim 1, further comprising forming a first plating layer on each of the resistor blanks such that the first plating layer covers an adjacent one of the upper electrodes, an adjacent one of the side electrodes, and an adjacent one of the lower electrodes.

3. The method of claim 2, further comprising forming a second plating layer that covers the first plating layer.

4. The method of claim 3, further comprising forming a third plating layer that coves the second plating layer.

5. The method of claim 1, wherein formation of the upper and lower electrodes in step (b) is conducted through printing techniques.

6. The method of claim 1, wherein formation of the lower electrodes in step (b) is conducted through foil laminating techniques.

7. The method of claim 1, wherein formation of the lower electrodes in step (b) is conducted through sputtering techniques.

8. The method of claim 1, wherein formation of the lower electrodes in step (b) is conducted through coating techniques.

9. The method of claim 1, wherein formation of the strip-like resistor film in step (c) is conducted through printing techniques.

10. The method of claim 1, wherein formation of the strip-like resistor film in step (c) is conducted through foil laminating techniques.

11. The method of claim 1, wherein formation of the strip-like resistor film in step (c) is conducted through sputtering techniques.

12. The method of claim 1, wherein formation of the hole pattern in step (e) is conducted using laser techniques.

13. The method of claim 1, wherein formation of the strip-like side electrodes in step (h) is conducted using a silver paste.

14. The method of claim 1, wherein formation of the strip-like side electrodes in step (h) is conducted through sputtering techniques.

* * * * *